US006417604B1

(12) United States Patent
Hartmann et al.

(10) Patent No.: US 6,417,604 B1
(45) Date of Patent: Jul. 9, 2002

(54) LOW PRESSURE GAS DISCHARGE SWITCH

(75) Inventors: Werner Hartmann, Grossenseebach; Günter Lins, Erlangen; Klaus-Dieter Rohde; Jan Stroh, both of Erlangen; Jörg Kieser, Forchheim; Ernst-Ludwig Hoene, Berlin, all of (DE)

(73) Assignee: Siemens Aktiengesellshaft, Munich (DE)

( * ) Notice: Subject to any disclaimer, the term of this patent is extended or adjusted under 35 U.S.C. 154(b) by 0 days.

(21) Appl. No.: 09/319,655

(22) PCT Filed: Dec. 9, 1997

(86) PCT No.: PCT/DE97/02864

§ 371 (c)(1),
(2), (4) Date: Sep. 10, 1999

(87) PCT Pub. No.: WO98/26442

PCT Pub. Date: Jun. 18, 1998

(30) Foreign Application Priority Data

Dec. 12, 1996 (DE) ..... 196 51 744

(51) Int. Cl.[7] ..... H01J 17/14; H01H 33/66

(52) U.S. Cl. ..... 313/155; 313/231.11; 313/231.31; 315/111.41; 315/338

(58) Field of Search ..... 313/155, 161, 313/156, 231.31, 231.41, 231.11; 315/111.41, 338

(56) References Cited

U.S. PATENT DOCUMENTS 5,019,752 A * 5/1991 Schumacher ..... 315/344
5,336,975 A * 8/1994 Goebel et al. ..... 315/11.41
5,585,696 A 12/1996 Koyama et al. ..... 315/111.41
5,828,176 A * 10/1998 Goebel ..... 315/111.41

FOREIGN PATENT DOCUMENTS

| | | | | |
|---|---|---|---|---|
| DE | 3900684 | * | 7/1990 | ..... H01H/33/66 |
| EP | 0 121 180 | | 10/1984 | ..... H01H/1/02 |
| EP | 0 381 843 | | 8/1990 | ..... H01H/33/60 |
| JP | 05 159 851 | | 6/1993 | ..... H01T/2/00 |

* cited by examiner

*Primary Examiner*—Michael H. Day

(57) ABSTRACT

For a low-pressure gas discharge switch, at least two main electrodes are arranged at least a distance d from each other, the electrodes in an arcing chamber forming a cathode and an anode of a discharge path for the low-pressure gas discharge. The gas discharge is triggered by increasing the electron density in a cathode cavity, at least the cathode in its disk-shaped area having at least one aperture, the cathode and anode apertures preferably being opposite and aligned with each other, for triggering the discharge. An arrangement generating a magnetic field superimposed on the discharge between the main electrodes (1, 1*a*, 2, 2*a*) are assigned to the main electrodes (1, 1*a*, 2, 2*a*), with which either a predominantly parallel magnetic field is generated or a predominantly perpendicular one, with regard to the direction of current in the discharge. The magnetic field generator may include slot arrangements (11, 11', 21, 21') in hollow cylinders (1*b*, 2*b*), which are part of the anode (1) and cathode (2) configured as hollow electrodes, or may be realized in the associated current supply lines.

18 Claims, 3 Drawing Sheets

LOW PRESSURE GAS DISCHARGE SWITCH

BACKGROUND INFORMATION

The present invention relates to a low pressure gas discharge switch, in which, for a low-pressure gas discharge, main electrodes are arranged at least at a distance d from each other. The electrodes in an arcing chamber form a cathode and an anode of a discharge path for the low-pressure gas discharge that is triggered by increasing the electron density in a cathode cavity. At least the cathode in its disk-shaped area has at least one aperture for triggering the discharge. The cathode and anode apertures being opposite, and aligned with, each other. An arrangement for generating a magnetic field is assigned to the main electrodes.

Low-pressure gas discharge switches for switching of high pulse-shaped currents and power outputs are essentially composed of at least two main electrodes, of which at least the cathode has one or a plurality of apertures which are designated as trigger apertures. Via this (these) aperture(s), the area between the main electrodes is connected to the area behind the cathode. In this cathode rear space, a trigger device is generally arranged, with whose assistance electrons are released which initiate, i.e., trigger, the necessary main discharge in the area between the anode and cathode, to close the switch.

In switches having thermionic electron generation, i.e., a thyratron, there is, in the cathode rear space, an electrically heated electrode which not only makes the necessary electrons available for triggering the main discharge, but also supplies the greater part of the overall current during the main discharge and thus acts as a thermionic cathode. After each use of the thyratron, however, a significant part of the current continues to flow via the cold cathode and, as a result of vaporization and atomization of the electrode material, leads to erosion of the material.

In low-pressure gas discharge switches, such as those described in WO 89/00354 A1 or German Patent No. 28 04 393 A1, the entire current of the high-current main discharge flows via the cold cathode and leads there to increased erosion, which, in widening the trigger apertures, leads to the destruction of the cathode and thus to the end of the service life of the switching tube. The erosion, within certain limits, is proportional to the entire charge quantity transported by the switch, the quantity thus decisively influencing the service life of the switch. In response to high current densities, i.e., given a small cross-section of the discharge, the erosion rate increases disproportionately; in addition, if the discharge has a small discharge cross-section, a high local volume erosion rate has significantly greater effects than if the discharge has a large discharge cross-section.

The main problem for achieving a long service life of such switching systems is therefore to make the discharge cross-section as large as possible and to provide for a homogeneous current distribution over the entire discharge cross-section. In this way, the erosion is reduced locally and, overall, is distributed equally over a larger surface, so that the result is a uniform wearing away of the electrode instead of locally pronounced erosion. Furthermore, by increasing the discharge cross-section it is achieved that the greater part of the vaporized or atomized electrode material is deposited again on the electrode opposite, so that by increasing the discharge cross-section, a disproportionate reduction of the macroscopically detectable erosion can be achieved.

Low-pressure gas discharge switches are known in various specific embodiments. Specific embodiments having only one, particularly round, aperture in the cathode are also called pseudo-spark switches, and are described in, e.g., WO 89/00354 A1 and German Patent No. 28 04 393 A1. Especially in the switches shown there, there is an aperture in the anode that is identical to, and aligned with, the aperture in the cathode, for maintaining a symmetrical arrangement independent of polarity.

The parallel connection of such individual discharge channels for reducing the load of the individual switching channel is conventional, and it is specifically described in the specialized literature for accommodating the individual channels in a common vacuum housing. The accommodation of individual discharge channels in separate housings is also conventional. Slot-shaped apertures for enlarging the electrode surface are described in German Patent No. 42 40 198 C1. Finally, it is conventional to use a plurality of slot-shaped apertures in the cathode of thyratrons which are operated predominantly using a cold cathode in the so-called "grounded-grid" mode.

A further method for increasing the discharge cross-section is described in detail in U.S. Pat. No. 5,146,141. There, the enlargement of the discharge cross-section is achieved because in the cathode, instead of an aperture, a recess is provided, over whose surface the discharge spreads out, given suitable geometry. The triggering of the discharge is achieved by holes in the edge region of the recess, which connect the actual discharge chamber, between the anode and the cathode, to the cathode rear space and a trigger device accommodated there.

Common to all hitherto known embodiments is that wear and tear takes place through the erosion of the cathode, the erosion, at a time point that cannot be predicted in advance, becoming spatially inhomogeneous, i.e., becoming locally intensified.

This is particularly caused by the self-generated magnetic field of the discharge, as a result of which the discharge tends to be constricted (so-called pinch effect). Since the discharge is triggered due to the low working pressure, preferably assuming the largest aperture, therefore, given the existing asymmetry, a certain point, already in the triggering of the discharge, is favored at which the discharge then burns in a concentrated fashion and at which therefore the erosion becomes more intense. In this way, this undesirable effect intensifies and the service life of the switching element is prematurely limited by local erosion.

A gas discharge switch is also described in Japanese Patent No. 5,159,851. In this gas discharge switch, a means for generating a magnetic filed in the switch is formed using slot arrangements. The slots in the arrangement run in the same direction and are in the walls of hollow electrodes. This means superimposes a parallel, i.e., axial (with respect to the direction of current in the discharge), magnetic field.

An objective of the present invention is to provide a low-pressure gas discharge switch having a cold cathode such that the erosion, particularly of the cathode, is reduced.

In an first example embodiment of the present invention, main electrodes are provided having disk-shaped bottoms. These main electrodes may be provided with radial slots for avoiding eddy current effects. Additionally, a magnetic field generator is provided which produces a substantially parallel magnetic field, i.e., an axial field, with respect to the direction of current in the discharge. An auxiliary electrode may also be provided for electrically triggering a switching process.

In another example embodiment, the main electrodes are provided with disk-shaped bottoms. These main electrodes are provided with slots that run substantially tangentially or in a spiral shape. The magnetic field generator produces a substantially perpendicular magnetic filed, i.e., a radial field, with respect to the direction of current in the discharge. An auxiliary electrode ma also be provided for electrically triggering a switching process.

The means for generating the magnetic fields are preferably realized through slot arrangements in the cylinders completing the anode, on the one hand, and the cathode, on the other hand. However, it is also possible to arrange the slot arrangements in the power supply conductors to the cathode and/or the anode.

The predominantly axial or radial magnetic fields, with respect to the circular symmetry of the low-pressure gas discharge switch, can be influenced by a corresponding tilt of the slots in the different partial units or the arrangement of the permanent magnets or arrangement of individual coils of various types.

Arcs that are superimposed on magnetic fields and the associated means for generating such magnetic fields are already known in principle from the technology of vacuum switches. Especially in connection with gas discharge switches, such magnetic fields surprisingly generate unexpected advantages, since the damaging erosion of the electrodes is reduced particularly for the continuous operation of a gas discharge switch.

The latter is possible as a result of the knowledge that in the low-pressure range switching plasmas can be expanded, using magnetic fields, two or three orders of magnitude more quickly than with the conventional arrangements of vacuum switches. Only in this way is the use of magnetic fields superimposed on the switching plasma sensible in the case of short pulses, since using the previously known expansion speeds of switching plasmas in a vacuum, i.e., in vacuum arcs, no significant improvement of the switching performance and of the erosion of the electrodes can occur for short, high-current discharges.

DETAILED DESCRIPTION

In each case, in the individual Figures, an identically configured low-pressure gas discharge switch, in principle furnished with hollow electrodes, is depicted as it is known in the Prior Art. Specifically, reference in this regard is made to the documents treated in the introduction with regard to the Prior Art.

To achieve large discharge cross-sections in low-pressure gas discharge switches, experience teaches that an axial magnetic field superimposed on a discharge exercises a stabilizing effect on the discharge itself and in certain cases prevents, or at least reduces, a constricting of the discharge to small cross-sections. In vacuum switches having movable electrodes, it is known that an axial magnetic field superimposed on the arc exercises a stabilizing effect of this type, as a result of which the arc voltage of the arc discharge is reduced, and the arc can be kept in a diffuse condition over a larger cross-section. This magnetic field, inter alia, is generated because one or both contact carriers is/are configured as a coil. The arc in vacuum switches is produced by mechanically separating the current-conducting contact pieces touching each other, the expansion of the arc over a larger cross-section taking place via the expansion of the metal vapor arising in the discharge and via the ignition of new cathode base points in areas of sufficiently high metal vapor density.

In contrast, in low-pressure gas discharge switches the ignition of the discharge between the stationary electrodes is initiated by injection of free charge carriers, i.e., electrons. The formation of plasma consequently takes place largely in the working gas. An expansion of the discharge cross-section in the working gas is therefore not dependent on the expansion of the metal vapor and can therefore proceed significantly more quickly. Due to the presence of a preselected low-pressure gas filling, the electrode erosion is significantly reduced, since the gas filling replaces a significant part of the vapor density necessary for current transport.

Whereas in vacuum switches having movable contacts a pressure upper limit of approximately $10^{-3}$ Pa is indicated in the literature as the correct mode of functioning for switching off high currents, the optimal pressure for the function of switching on high currents required by the present invention is typically in the range of between approximately 1 Pa and 200 Pa, given stationary electrodes at a distance typically of some mm. The knowledge that axial magnetic fields, in this pressure range and in current flow durations of only a few microseconds, have a stabilizing and homogenizing effect on the discharge plasma, is surprising in this connection and can be exploited for particularly advantageous solutions.

Figure 1:
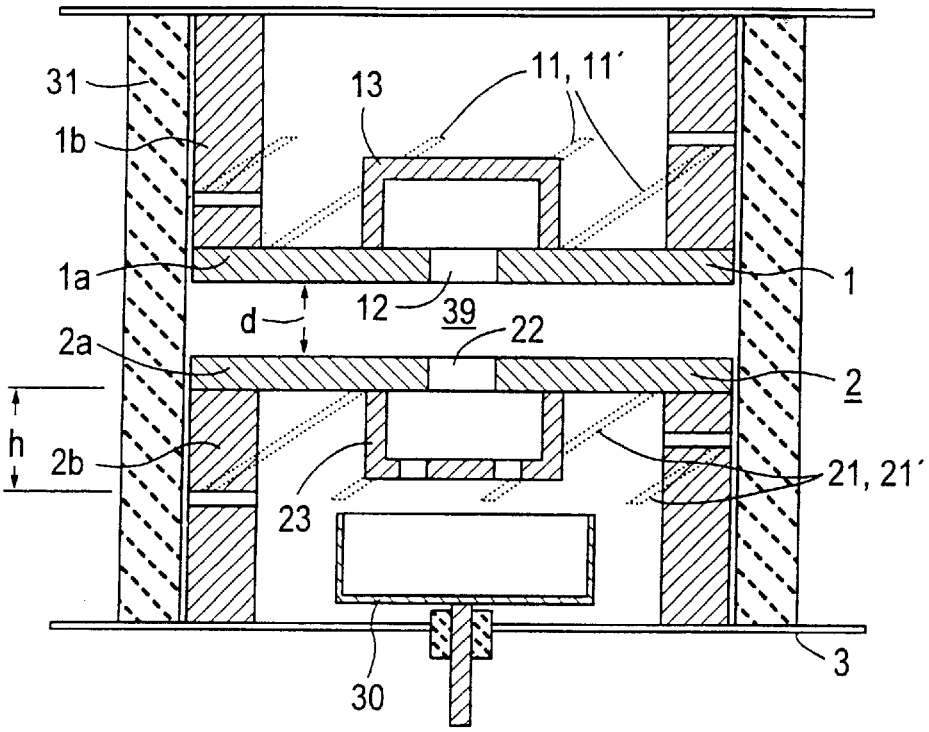
FIG. 1 shows a gas discharge switch in cross-section having a slot arrangement in a hollow cylinder supporting the cathode and the anode, the slot arrangements in both cylinders running in the same direction, according to an example embodiment of the present invention.
Figure 2:
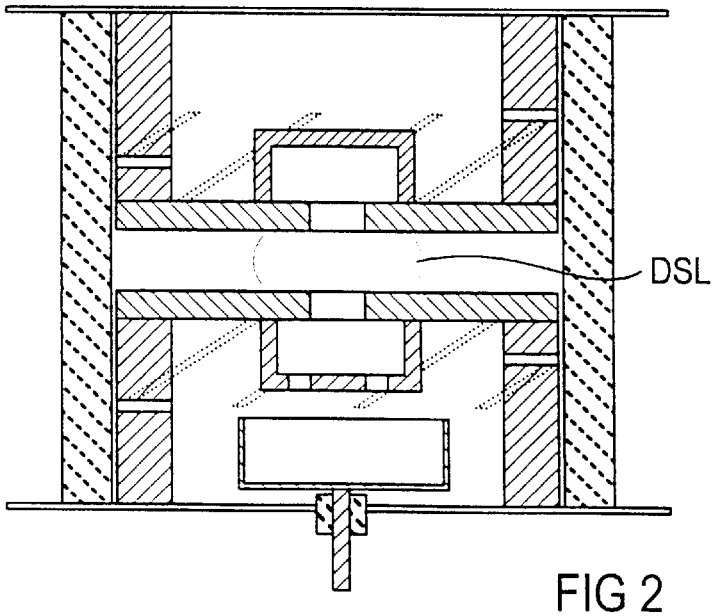
FIG. 2 shows the switch according to FIG. 1 in switching operation having a stationary arc that is diffusely formed.

In FIG. 1 and FIG. 2, an example embodiment of a low-pressure gas discharge switch that can be triggered from the outside, i.e., triggerable, is depicted in detail, in which a stabilization of the arc is achieved through an axial magnetic field generated in the power supply conductor area. The switch is composed of two stationary, rotationally symmetric, and cup-shaped electrodes 1 and 2, each composed of a "cup" bottom 1*a* and 2*a* having distance d between them, and a hollow cylindrical "cup" wall 1*b* and 2*b*. In this context, electrode 1 realizes the anode and electrode 2 realizes the cathode for the discharge.

In FIG. 1, both electrode cylinders 1*b* and 2*b* have a slot arrangement, composed of at least two transverse slots 11 and 21, respectively. Slots 11 and 21, in this context, are distributed equally over the periphery and constitute, for each cylinder wall 1*b* and 2*b*, at least one entire winding.

The number and angle of slots 11 and 21 determine the strength of the proportion of axial magnetic field created in the axle area. To reduce the eddy current moving in the opposite direction inevitably produced in electrode bottoms 1*a* and 2*a*, it is expedient to provide these areas with slots that have a radial component. Thus a reduction of the axial magnetic field is avoided.

At least cathode 2 has an aperture 22 in the axis area, the aperture connecting the side of the cathode turned toward the anode to the so-called cathode rear chamber, which forms a hollow cathode 23. The aperture is composed, for example, of a circular bore having a diameter of approximately 2 to 10 mm; but annular apertures are also possible.

Electrodes 1 and 2 are located in a gas-tight, closed housing 3 and are supported by an annular tube segment 31 made of insulating material at a preselected distance of typically 2 to 8 mm. The entire area within housing 3 is filled with an ionizable gas filling in the pressure range between 1 and 200 Pa. Suitable for the gas are hydrogen or deuterium or a mixture of them, which can be stored, in accordance with the Prior Art, in metal hydride storage chambers and released selectively by warming up the storage chamber.

In the operating condition of the switch, the gas pressure is adjusted so that the gas path in all the areas between anode 1 and cathode 2 resists the applied voltage, i.e., is electrically insulating ("open"), and no independent discharge can occur. The switch is closed electrically by the fact that in gap 39 between anode bottom 1*a* and cathode bottom 2*a* a discharge plasma is produced which connects, in an electrically conductive manner, anode 1 and cathode 2 as main electrodes.

Using a trigger electrode 30, the discharge is triggered by producing a sufficient number of free charge-carriers in hollow cathode 23. Typically, approximately $10^8$ through $10^{11}$ free electrons are required within a time period of from 10 to 100 ns. For generating the trigger electrons, a series of methods is known: for example, pulsed gas discharges or a pulsed extraction from stationary gas discharges, pulsed corona discharges, pulsed creeping discharges on insulator surfaces, thermionic cathodes, external photoelectric effect, ferroelectric electron sources, among others, can be used. The trigger electrons lead to creating a transient hollow cathode discharge in hollow electrode area 23, i.e., a gas discharge, whose discharge plasma expands from area 23 into the area between the anode and cathode and connects the two electrodes 1 and 2 in an electrically conductive manner. An arc-like, diffuse discharge, in this context, is promoted by the symmetry of the discharge.

The supply of the discharge current to the area of the discharge in the center of electrodes 1 and 2 occurs due to the cup-shaped structure of electrodes 1 and 2 always via the bars of the coil winding formed from slots 21 and 11. In this way, in the central area of electrodes 1 and 2, a predominantly axial magnetic field is produced. This magnetic field prevents the discharge plasma, in particular at high current intensities, from contracting to a discharge channel of a small diameter due to the pinch effect, in that the interior plasma pressure is correspondingly increased by "freezing" the axial field. In this way, a diffuse discharge having low local erosion rates is achieved even at high current intensities of over 40 kA, whereas otherwise it is known that the discharge at high current intensities has a tendency to build a dense, contracted metal vapor arc having arc erosion rates that are higher by orders of magnitude.

For raising the magnetic field intensity of the axial field, it is advantageous to provide the anode with slots 11 which have the same slot direction as the slots of cathode 21. In this way, the axial field components of anode 1 and cathode 2, in the contact gap and in discharge area 39, are superimposed in the same direction, which raises the total axial field intensity. In this context, cathode aperture 22 and a comparable anode aperture 12 have a diameter that is typically roughly one magnitude smaller than the external diameter of cup-shaped electrodes 1 and 2.

FIG. 2 makes clear how arc diffuse stationary arc [Diffuser Stationaerer Lichtobgen] (DSL), stabilized by the axial magnetic field, is formed in a diffuse, homogeneous manner around electrode apertures 12 and 22 and is stationary in this condition. For avoiding eddy current effects, at least one of the disk-shaped electrode bottoms 1*a* or 2*a* can have slots predominantly in the radial direction, as can be seen by way of example as radial slots 32 in FIG. 5.

Figure 3:
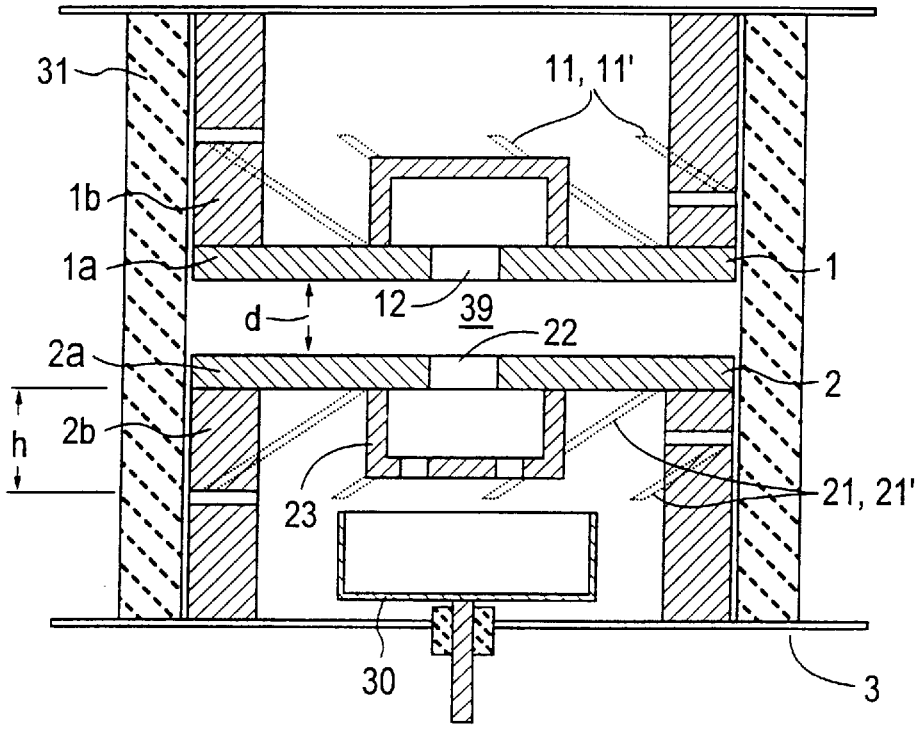
FIG. 3 shows a low-pressure gas discharge switch in cross-section corresponding to FIG. 1, in this case the slot arrangements in the hollow cylinders running in opposite directions.
Figure 4:
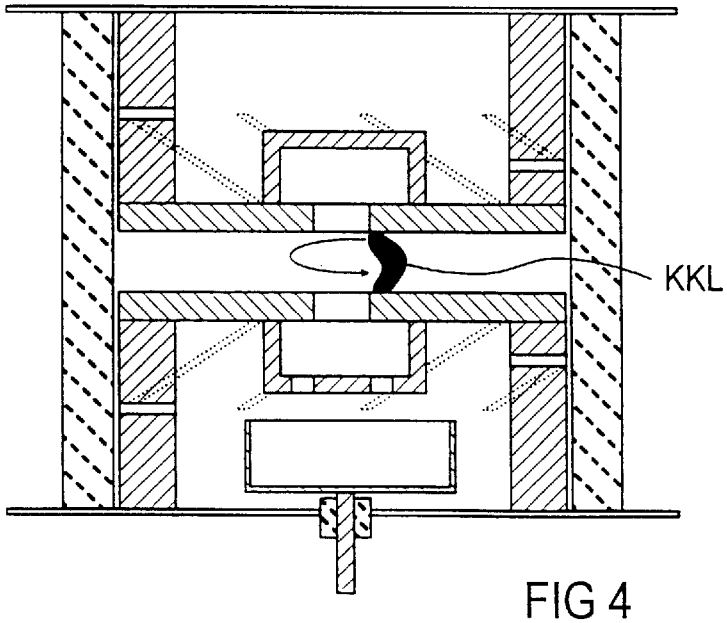
FIG. 4 shows the switch according to FIG. 3 in switching operation having a concentrated arc rotating in a circle.

In the specific embodiment according to FIGS. 3 and 4, in place of the axial magnetic field a radial magnetic field is used in contact gap 39 between anode 1 and cathode 2, to place into an azimuthal rotating motion the arc commutated at the area of the edge of aperture 22 and 12. In this way, the local effect of the arc especially in current pulses of long duration are spread evenly over a large area, and in this way a disproportionately intense, locally damaging effect on the electrodes is avoided.

In order to achieve the latter, in accordance with FIGS. 3 and 4, the electrode cylinders 1*b* and 2*b* are slotted in opposite directions. Alternatively, to generate a radial magnetic field, disk-shaped bottoms 1*a* and 2*b* of anode and cathode can have slots, not depicted in detail, which run predominantly tangentially or in a spiral shape.

FIG. 4 especially clarifies how a concentrated arc circular running concentrated arc [Kreisfoermig umlaufender Konzentrierter Lichtbogen] (KKL), in a specific embodiment according to the present invention, moves in a circular motion around the electrode bores due to the radial magnetic field, as a result of which local damage to the electrode disks is avoided. In this way, in particular at currents of high amplitudes of several tens of kA to over 100 kA and at long current flow durations, equalized utilization of the surface and a long service life of the electrodes are achieved.

Alternatively, for generating a radial magnetic field, disk-shaped bottoms 1*a* and 2*b* of anode and cathode can have slots which run predominantly tangentially or in a spiral shape.

Figure 5:
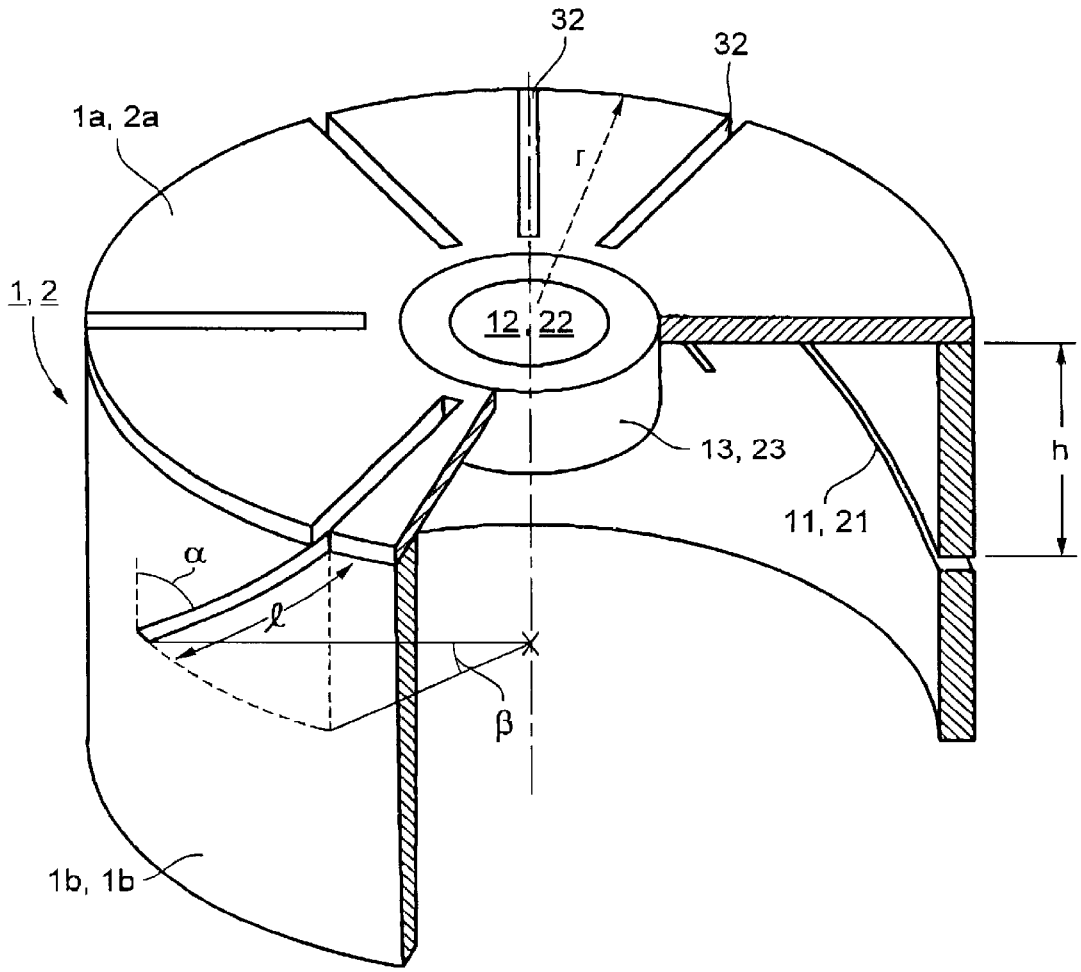
FIG. 5 shows a hollow electrode, cutaway in the front in a perspective representation, for clarifying the slot geometry.

In FIG. 5, a single hollow electrode 1 and 2, for use as cathode and anode, respectively, is clarified in a front cutaway view in a gas discharge switch in accordance with FIG. 1 and FIG. 3. Apart from radial slots 32, the geometry of the slot arrangement for producing the magnetic field is particularly obvious, the angle of slots 11, 11' and 21, 21' with respect to the vertical being represented by $\alpha$ and the azimuth angle of an individual slot with respect to the periphery being represented by $\beta$. Length l of a single slot is dependent on the angle position and the height h of the coil. The intensity of the magnetic field is determined, assuming n slots, by overall length L, wherein L is the sum of the single slots of length l. For assuring sufficient magnetic field intensity, the following should hold:

$$L = \sum_n l > 2\pi r; \text{ and}$$

$$n \cdot \beta > 360°.$$

Therefore, a sufficient axial or radial magnetic field can be generated by at least one complete coil winding.

Research has shown that the axial magnetic field, for use in the gas discharge switch described, should be at least 1 mT per kA of the current to be switched, and the radial magnetic field for use in the gas discharge switch described should be 2 mT per kA of the current to be switched, but at least 30 mT.

The material, at least for bottoms 1*a* and 1*b* of hollow electrodes 1 and 2 in the gas discharge switches according to FIGS. 1 and 3, is composed advantageously of a copper-chrome (CuCr) alloy. The material CuCr40 has been shown to be particularly suitable for minimizing the erosion at the discharge aperture.

What is claimed is:

1. A low-pressure discharge switch, comprising:

main electrodes arranged at a distance from each other, the main electrodes having disk-shaped bottoms, the disk-shaped bottoms having substantially radial slots for avoiding eddy current effects;

an arcing chamber, the main electrodes being positioned within the arcing chamber and forming a cathode and an anode of a discharge path for a low-pressure gas discharge, the cathode having an aperture, the discharge being triggered by increasing an electron density in the at least one aperture of the cathode, the anode including an aperture, the aperture of the anode and the aperture of the cathode being opposite and aligned with each other;

a magnetic field generator assigned to the main electrodes, the magnetic field generator generating a magnetic field superimposed on the discharge, the magnetic field being substantially parallel with respect to a direction of current in the discharge; and an auxiliary electrode associated with the cathode, the auxiliary electrode electrically triggering a switching process.

2. The low-pressure gas discharge switch according to claim 1, wherein the magnetic field generator is formed by a slot arrangement in cylinders, the cylinders forming a portion of the anode and the cathode.

3. The low-pressure gas discharge switch according to claim 2, wherein slots in the slot arrangement in the cathode cylinder and slots in the slot arrangement in the anode cylinder are tilted in the same direction.

4. The low-pressure gas discharge switch according to claim 2, wherein the magnetic field depends on a number and an angle of slots in the slot arrangement, the magnetic field further depending on an overall length, the overall length being determined using the following formulae:

$$L = \sum_n l > 2\pi r; \text{ and}$$

$$n \cdot \beta > 360°.$$

where L is the overall length, l is the length of one slot, r is the radius of a cylinder, n is the number of slots and β is the peripheral angle of a single coil segment defined by the slots.

5. The low-pressure gas discharge switch according to claim 1, wherein the magnetic field generator is formed by a slot arrangement of current supply lines to at least one of the cathode and the anode.

6. The low-pressure gas discharge switch according to claim 5, wherein the magnetic field depends on a number and an angle of slots in the slot arrangement, the magnetic field further depending on an overall length, the overall length being determined using the following formulae:

$$L = \sum_n l > 2\pi r; \text{ and}$$

$$n \cdot \beta > 360°.$$

where L is the overall length, l is the length of one slot, r is the radius of a cylinder, n is the number of slots and β is the peripheral angle of a single coil segment defined by the slots.

7. The low-pressure gas discharge switch according to claim 1, wherein an intensity of the magnetic field is at least 1 mT per kA in current to be switched.

8. The low-pressure gas discharge switch according to claim 1, wherein the bottoms of the main electrodes include a copper-chromium material.

9. The low-pressure gas discharge switch according to claim 1, wherein a product of a pressure of gas in the switch and the distance between the main electrodes in the switch is less than 200 Pa·mm and more than 1 Pa·mm.

10. A low-pressure discharge switch, comprising:

main electrodes arranged at a distance from each other, the main electrodes having disk-shaped bottoms, the disk-shaped bottoms having one of i) substantially tangentially running slots, and ii) slots which run in a spiral shape;

an arcing chamber, the main electrodes being positioned within the arcing chamber and forming a cathode and an anode of a discharge path for a low-pressure gas discharge, the cathode having an aperture, the gas discharge being triggered by increasing an electron density in the at least one aperture of the cathode, the anode including an aperture, the aperture of the anode and the aperture of the cathode being opposite and aligned with each other;

a magnetic field generator assigned to the main electrodes, the magnetic field generator generating a magnetic field superimposed on the discharge, the magnetic field being substantially perpendicular with respect to a direction of current in the discharge; and an auxiliary electrode associated with the cathode, the auxiliary electrode electrically triggering a switching process.

11. The low-pressure gas discharge switch according to claim 10, wherein the magnetic field generator is formed by a slot arrangement in cylinders, the cylinders forming a portion of the anode and the cathode.

12. The low-pressure gas discharge switch according to claim 11, wherein slots in the slot arrangement in the cathode cylinder and slots in the slot arrangement in the anode cylinder are tilted in the opposite directions.

13. The low-pressure gas discharge switch according to claim 11, wherein the magnetic field depends on a number and an angle of slots in the slot arrangement, the magnetic field further depending on an overall length, the overall length being determined using the following formulae:

$$L = \sum_n l > 2\pi r; \text{ and}$$

$$n \cdot \beta > 360°.$$

where L is the overall length, l is the length of one slot, r is the radius of a cylinder, n is the number of slots and β is the peripheral angle of a single coil segment defined by the slots.

14. The low-pressure gas discharge switch according to claim 10, wherein the magnetic field generator is formed by a slot arrangement of current supply lines to at least one of the cathode and the anode.

15. The low-pressure gas discharge switch according to claim 14, wherein the magnetic field depends on a number and an angle of slots in the slot arrangement, the magnetic field further depending on an overall length, the overall length being determined using the following formulae:

$$L = \sum_n l > 2\pi r; \text{ and}$$

$$n \cdot \beta > 360°.$$

where L is the overall length, l is the length of one slot, r is the radius of a cylinder, n is the number of slots and β is the peripheral angle of a single coil segment defined by the slots.

16. The low-pressure gas discharge switch according to claim 10, wherein an intensity of the magnetic field is at least 2 mT per kA in a current to be switched, and at least 30 mT.

17. The low-pressure gas discharge switch according to claim 10, wherein the bottoms of the main electrodes include a copper-chromium material.

18. The low-pressure gas discharge switch according to claim 10, wherein a product of a pressure of gas in the switch and the distance between the main electrodes in the switch is less than 200 Pa·mm and more than 1 Pa·mm.

* * * * *